US005176578A

United States Patent [19]

Smith

[11] Patent Number: 5,176,578

[45] Date of Patent: Jan. 5, 1993

[54] PROTECTIVE COVER FOR A HINGED CONNECTION

[75] Inventor: Samuel G. Smith, West Point, Miss.

[73] Assignee: Par Industries, Inc., Medina, Ohio

[21] Appl. No.: 831,409

[22] Filed: Feb. 5, 1992

[51] Int. Cl.[5] ..... A63G 9/00; E05D 11/00

[52] U.S. Cl. ..... 472/118; 16/250

[58] Field of Search ..... 16/250, 251; 248/370; 472/118, 120, 125; 403/23

[56] References Cited

U.S. PATENT DOCUMENTS

| | | | |
|---|---|---|---|
| 3,584,823 | 6/1971 | Andrew et al. | 248/164 |
| 3,713,466 | 1/1973 | Lund | 30/382 |
| 3,754,786 | 8/1973 | Boucher et al. | 16/250 |
| 3,808,684 | 5/1974 | Ludwig | 30/382 |
| 4,961,558 | 10/1990 | Cunard . | |

FOREIGN PATENT DOCUMENTS

| | | | |
|---|---|---|---|
| 2144454 | 2/1978 | Fed. Rep. of Germany | 248/164 |

*Primary Examiner*—Robert L. Spruill
*Assistant Examiner*—Carmine Cuda
*Attorney, Agent, or Firm*—Renner, Kenner, Greive, Bobak, Taylor & Weber

[57] ABSTRACT

A protective cover assembly is particularly adapted for a play gym having a horizontal beam member (12), a hanger bracket (15) supported from the beam member (12) and a pair of hanger bars (13 and 14) pivotally depending from the hanger bracket (15) for swinging motion through an angular extent. The protective cover assembly (10) itself utilizes a pair of mirror-image cover caps (55), each of which include a concavo-convex wall (60) that has an outer circumference and a central portion. A collar (63) extends through the central portion of the concavo-convex wall (60), and a peripheral wall (61) is presented from the outer circumference of the concavo-convex wall (60). The peripheral wall (61) is recessed (at 62) along a predetermined circumferential extent. Fasteners (69 and 71) secure the mirror-image caps (55) together with the peripheral walls (61) being disposed in abutment, the collars (63) being axially aligned and the recesses (62) defining a slot (75) of sufficient axial dimension as well as of sufficient, predetermined, circumferential dimension to receive the hanger bars (13 and 14). Because of the aforesaid structural arrangement, the protective cover assembly (10) will rotate on the horizontal beam member (12) in response to the swinging movement of the hanger bars (13 and 14).

3 Claims, 3 Drawing Sheets

PROTECTIVE COVER FOR A HINGED CONNECTION

TECHNICAL FIELD

The present invention relates to protective covers. More particularly, the present invention relates to protective covers for a hinged connection. Specifically, the present invention relates to covers that protect against unauthorized insertion of foreign objects, including children's fingers, into the pivotal hinge connection between a hanger bracket and the hanger bars for one or more of the swinging items on a play swing without limiting the pendulum-like motion of the hanger bars.

BACKGROUND OF THE INVENTION

Children's swing sets, or gym sets, generally include several items of play equipment which are individually suspended from a common, horizontal beam member. The beam member may be supported above the ground by a plurality of leg members. A glide swing that is adapted to support two passengers on horizontally spaced seats is one item that is commonly included in a swing set. Another item that is frequently employed with play gyms and which is employed to support two passengers on horizontally spaced seats is commonly called a lawn swing. The seats of either item, and particularly the glide swing are fastened to a pair of cross bars that are themselves pivotally supported from a pair of parallel, vertically disposed, hanger bars. A hanger bracket, secured to the horizontal beam member, has spaced hinge points from which the hanger bars are pivotally supported. The hanger bracket, hanger bars and cross bars form a pantograph which maintains the seats parallel with the ground, even while the hanger bars are swinging.

The pivot points by which the hanger bars are suspended from the hanger bracket can be reached by a child standing on either of the seats. Thus, it is quite easy for a foreign body such as a stick, or the fingers of a hand, to be inserted between the relatively movable members joined at the pivot points. In fact, there have been injuries to children in just that manner. Prior known protective devices have been overly expensive, have interfered with the swinging action, or are of overly large size, thereby detracting from the appearance of the gym set. The smaller, less expensive devices that have heretofore been proposed are rigidly secured to the horizontal bar and must be provided with a large slot, or vertical opening, to accommodate the full swing angle of the hanger bars.

One relatively well known prior art device provides a pair of horizontally spaced, cup-like plates which are fixedly positioned with respect to the horizontal beam member. The plates are spaced to provide a cavity within which to contain the hanger bracket and the pivotal connection of the hanger bars to the hanger bracket. The opposed plates provide an access aperture that extends along a significant extent of the circumference to accommodate at least the angular sweep of the hanger bars as they swing to and fro. Thus, the access aperture presents a space of sufficient magnitude that an object, including fingers, can be inadvertently inserted between the support bars and the access aperture. While this arrangement provides better protection than systems without covers, it does leave considerable room for improvement.

SUMMARY OF THE INVENTION

It is, therefore, a primary object of the present invention to provide a small, and therefore, unobtrusive, protective cover assembly for a pivotal hinge connection.

It is another object of the present invention to provide a cover assembly, as above, for the pivotal hinge connection of a swinging member of the type used, for example, on a children's play gym.

It is a further object of the present invention to provide a protective cover assembly, as above, which presents a minimum vertical opening to receive the swinging, hanger means used by the swinging items on a play gym, the circumferential span of said opening being no greater than that required to accommodate the hanger means in its static disposition.

It is a still further object of the present invention to provide a protective cover assembly, as above, which rotates in response to the swinging movement of the hanger means in order to present a minimum access opening to the hinged connection.

It is yet another object of the present invention to provide a protective cover assembly, as above, which is penetrated by a central opening that permits the cover assembly to be rotatably mounted on the horizontal beam member of a play gym, thereby allowing the cover assembly to be rotated in unison with the vertical hanger means.

It is an even further object of the present invention to provide a protective cover assembly for a hinge connection that supports a pair of hanger bars that extend downward between the opposed, mirror-image caps of the cover assembly in order to minimize access to the hinge connection.

It is yet another object of the present invention to provide a protective cover assembly in accordance with the aforesaid objects and which is relatively inexpensive to manufacture, install and maintain.

These and other objects of the invention, as well as the advantages thereof over existing and prior art forms, which will be apparent in view of the following detailed specification, are accomplished by means hereinafter described and claimed.

In general, a protective cover assembly embodying the concepts of the present invention is particularly adapted for a play gym having a horizontal beam member, a hanger bracket supported from the beam member and a pair of hanger bars pivotally depending from the hanger bracket for swinging motion through an angular extent. The protective cover assembly itself utilizes a pair of mirror-image caps, each of which include a concavo-convex wall that has an outer circumference and a central portion. A collar extends through the central portion of the concavo-convex wall to be rotatably supported on the horizontal beam member. A peripheral wall is presented from the outer circumference of the concavo-convex wall. The peripheral wall is recessed along a predetermined circumferential extent. Fastener means secure the mirror-image caps together with the peripheral walls being disposed in abutment, the collar means being rotatably supported on the horizontal beam member in axial alignment and the recesses defining a slot of sufficient axial dimension as well as of sufficient, predetermined, circumferential dimension to receive the hanger bars. Because of the aforesaid structural arrangement, the protective cover assembly will rotate on the horizontal beam member in response to the swinging movement of the hanger bars.

One exemplary embodiment of a protective cover assembly embodying the concepts of the present invention is deemed sufficient to effect a full disclosure of the subject invention. The exemplary protective cover assembly is described in detail without attempting to show all of the various forms and modifications in which the invention might be embodied; the invention being measured by the appended claims and not by the details of the specification.

DESCRIPTION OF AN EXEMPLARY EMBODIMENT

Figure 2:
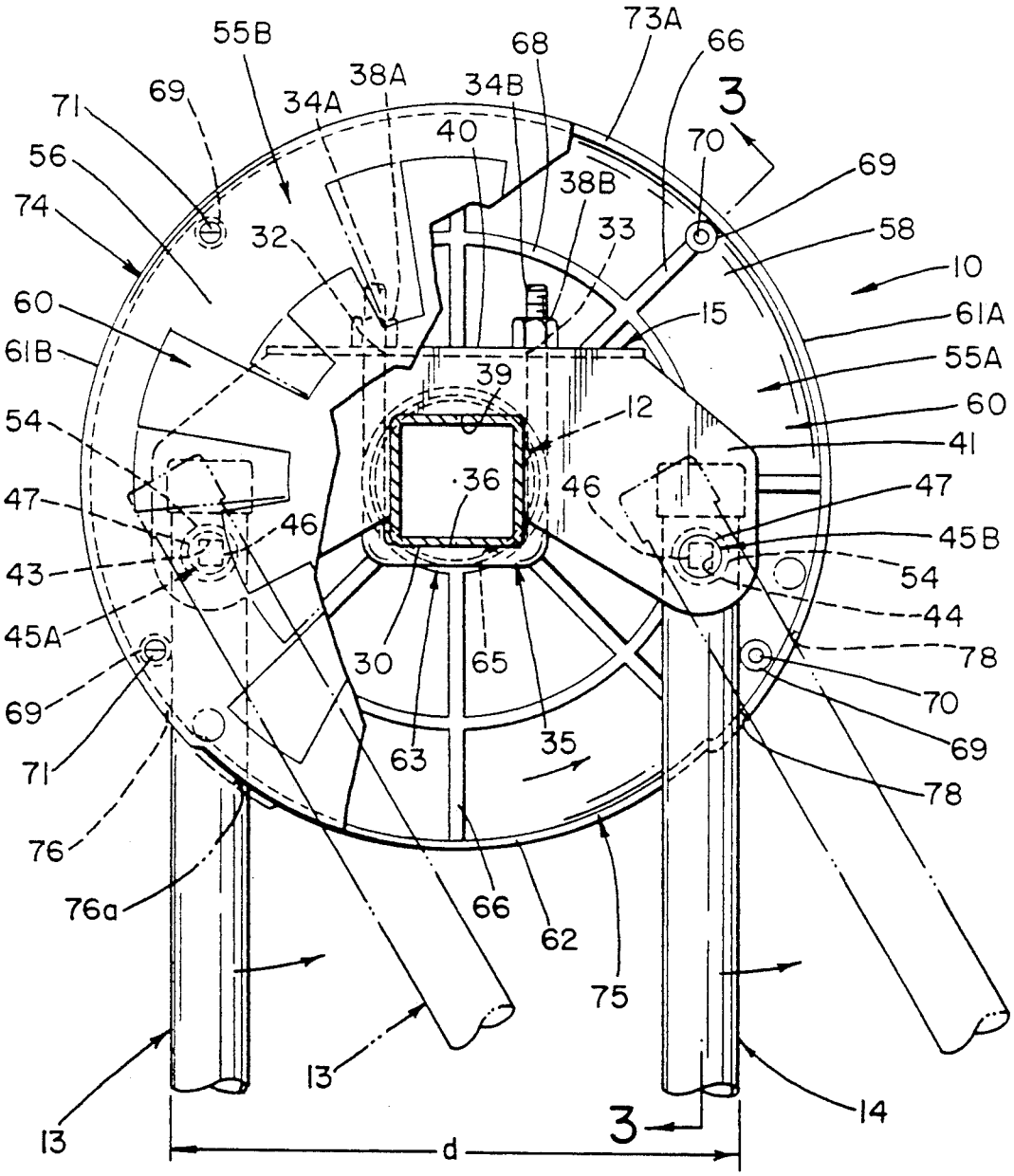
FIG. 2 is an enlarged, vertical section through the protective cover, as taken substantially along line 2—2 of FIG. 1.
Figure 3:
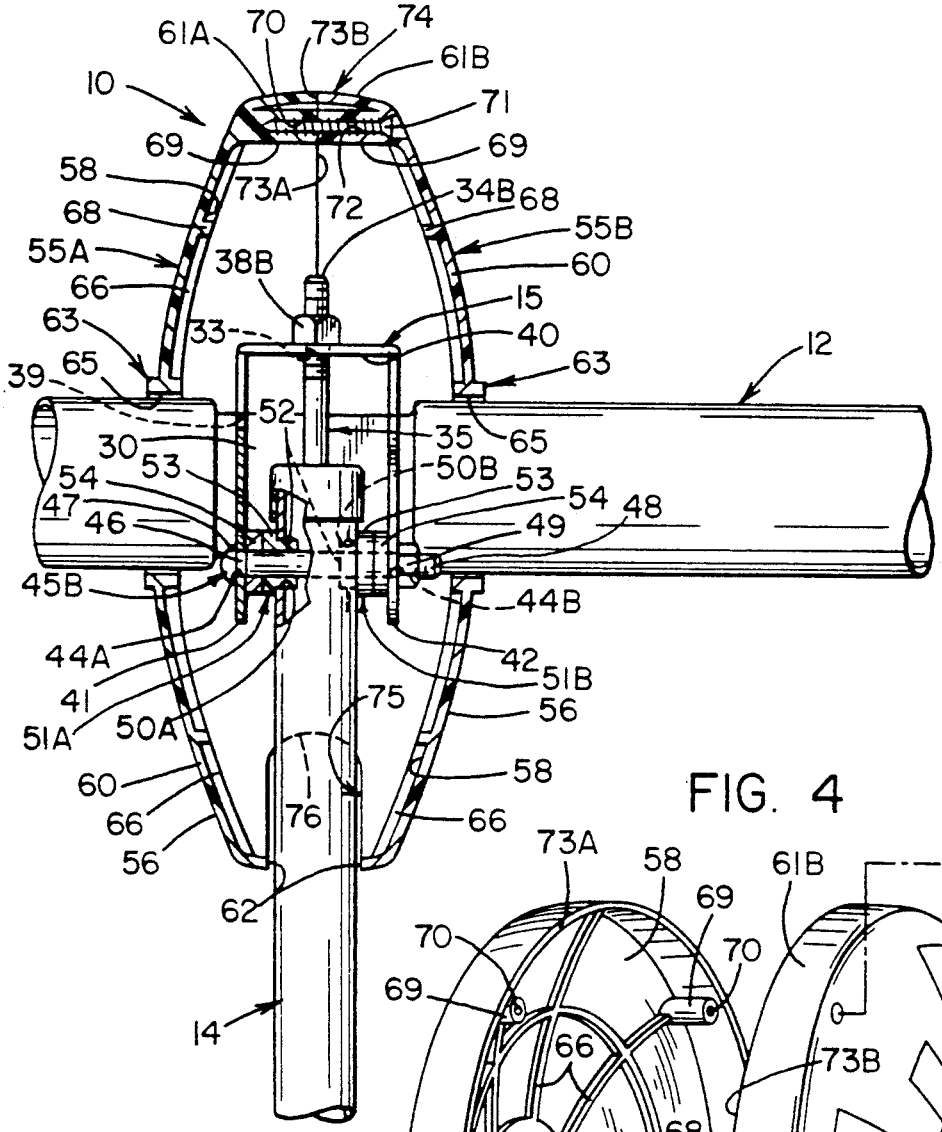
FIG. 3 is a further section taken along line 3—3 of FIG. 2.

One representative form of protective cover assembly embodying the present invention is designated generally by the numeral 10 on the accompanying drawings. The representative cover assembly 10 is depicted as being operatively associated with a glide swing 11 which is suspended from a horizontal support member in the nature of a tubular, beam member 12 that is supported by conventionally diverging end legs, not shown. A typical glide swing 11 has a pair of vertically depending hanger bars 13 and 14 which, as seen in FIGS. 2 and 3, are pivotally supported from a hanger bracket 15. Returning to the environmental representation of FIG. 1, the hanger bars 13 and 14 support a pair of cross bars 18 and 19 which are connected therewith by pivot pins 20 and 21, respectively. A pair of foot rests 23 and 24, respectively, are secured to the lower end portions 25 and 26 of the hanger bars 13 and 14.

Seats 28 and 29 are secured to the cross bars 18 and 19 in order that two riders may participate by simultaneously enjoying the pendulum-like swinging action. The riders occupy their respective seats 28 and 29 and place their feet on the foot rests 23 and 24. The riders alternately lean forwardly and rearwardly so the resulting force applied against the foot rests 23 and 24 and the center of gravity of the individual riders cause the hanger bars 13 and 14 to swing while the seats 28 and 29—as well as the cross bars 18 and 19—remain parallel to the ground.

As best seen in FIGS. 2 and 3, the hanger bracket 15 is secured to a substantially square section 30 of the otherwise tubular, horizontal beam member 12. The bracket 15 has a pair of spaced openings 32 and 33 through which the threaded leg portions 34A and 34B of a fastener, depicted as a modified U-bolt, 35 are inserted. The rectilinear bight 36 of the modified U-bolt 35 embraces the square section 30 of the beam member 12 such that when the nuts 38A and 38B are tightened into the respective, threaded leg portions 34A and 34B of the U-bolt 35 the hanger bracket 15 will be secured firmly against the beam member 12. To enhance the stability of the connection between the beam member 12 and the hanger bracket 15, the square section 30 of the beam member 12 may be received within a rectilinear recess 39 in the hanger bracket 15, thus ensuring that the bracket 15 will not rotate relative to the horizontally disposed, supporting beam member 12.

As preview in the previous paragraph, and as appears in the detailed description which follows, a particular structural member, component or arrangement may be employed at more than one location. When referring generally to that type of structural member, component or arrangement a common numerical designation shall be employed. However, when one of the structural members, components or arrangements so identified is to be individually identified it shall be referenced by virtue of a letter suffix employed in combination with the numerical designation employed for general identification of that structural member, component or arrangement. Thus, there are two threaded leg portions on the U-bolt 35, and the threaded leg portions are generally identified by the numeral 34, but the specific, individual leg portions are, therefore, identified as 34A and 34B in the specification and on the drawings. As such, the nuts 38A and 38B are threadably received on the respective leg portions 34A and 34B. This same suffix convention shall be employed throughout the specification.

The hanger bracket 15 has a web portion 40, and a pair of flanges 41 and 42 extend outwardly from the lateral edges of the web portion 40 in substantially parallel disposition. Registered bores 43, which, as shown, are preferably rectilinear for a purpose hereinafter more fully described, penetrate the flanges 41 and 42 on one side of the beam member 12, and a similar pair of registered openings 44, which are also preferably rectilinear, penetrate the flanges 41 and 42 on the other side of the beam member 12. A pivot pin 45A is received in, and supported by, the registered openings 43. A similar pivot pin 45B is received in, and supported by, the registered openings 44.

The rectilinear openings 43 and 44 are also preferably square in order cooperatively to interact with the pivot pins 45 that may be in the configuration of carriage bolts, each having a square shank portion 46. The interaction between the shank portions 46 and each opening 43 and 44 will, therefore, preclude rotation of the pivot pins relative to the mounting bracket 15. Moreover, by making both openings 43 as well as both openings 44 rectilinear, the pivot pin 45 may be effectively inserted from either side of the support bracket 15. The pivot pin 45A supports the hanger bar 13 for swinging movement, and the pivot pin 45B supports the hanger bar 14 for comparable swinging movement. The pivot pins 45 may have a head 47 (adjacent the square shank portion 46) on one end of the pivot pin shaft 48, and a nut 49 may be threadably received on the other end of the shaft 48.

The hanger bars 13 and 14 may be tubular, with a transverse opening 50 penetrating the upper end portion of each. A pair of opposed bushing members 51A and 51B (FIG. 3) may be received within the registered openings 50A and 50B as they diametrically penetrate each hanger bar 13 and 14. Specifically, the body portion 52 of each bushing member 51 may be rectilinear to engage the rectilinear openings 50 and thereby preclude relative rotational movement between the bushing members 51 and the hanger bars 13 or 14. A flange portion 53 extends radially outwardly from one end of the body portion 52 in each bushing member 51. The flange portion 53 engages the surface of a spacing washer 54 which is interposed between each bushing member 51 and the adjacent side flange 41 or 42 of the hanger bracket 15 to ensure that the square shank portion 46 of the pivot pins 45 will not engage the bushing member 51 in such a way as to preclude rotation of the respective bushing members 51 relative to the shaft 48 of the pivot pin 45 on which it is received. The bushing members 51 may well be fabricated from nylon or other such material which has a relatively low coefficient of friction as well as being "self lubricating."

The pivot pins 20 and 21 as well as 45A and 45B are disposed in the well known manner to provide the pantographic movement which assures that the cross bars 18 and 19 as well as the seats 28 and 29 supported thereon remain substantially parallel to the hanger bracket 15, and thus the ground, even as the glide swing moves back and forth.

Figure 4:
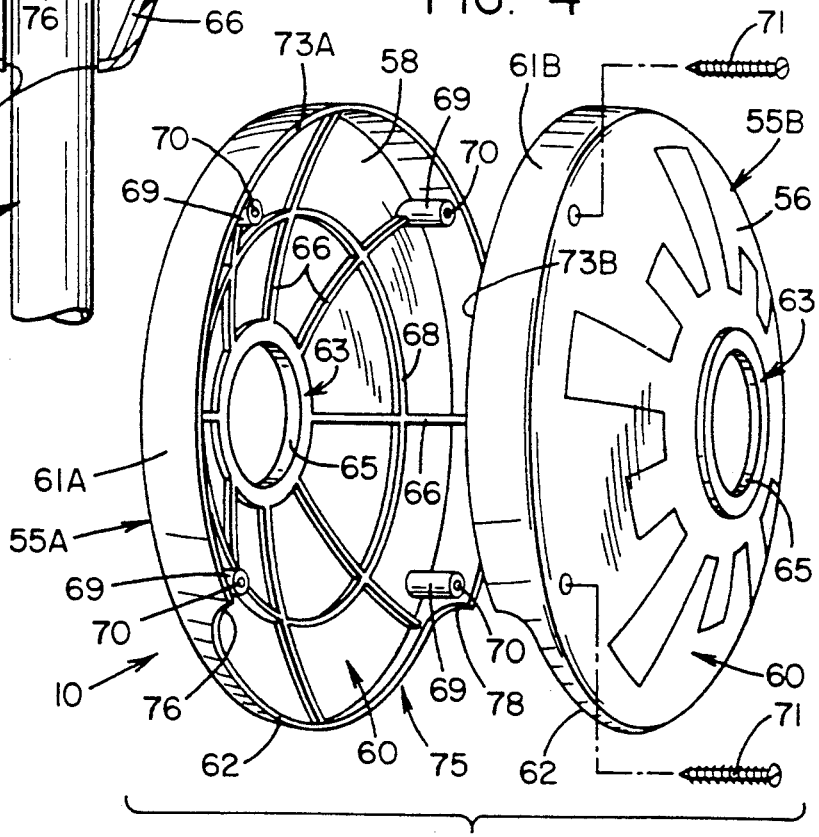
FIG. 4 is an exploded perspective of the protective cover to show representative interior and exterior surfaces of the opposed, mirror-image caps which combine to form the protective cover assembly.

The cover assembly 10 incorporates a pair of mirror image cover caps 55. Because the caps 55A and 55B are substantially identical, a detailed description of one cap will be satisfactory to described both caps. FIG. 4 depicts the outer surface 56 of cover cap 55B, and the inner surface 58 of the cover cap 55A. Each cap has a concavo-convex wall 60 from which the outer and inner surfaces 56 and 58 are presented. An annular peripheral wall, or skirt, 61 circumscribes the concavo-convex wall 60, and the lower portion of the peripheral wall 61 is recessed, as at 62, to accommodate the hanger bars 13 and 14 as will be more fully hereinafter described. An annular collar 63 pierces the central portion of each wall 60, and the collar 63 has an inner diameter that is substantially equal to the outer diameter of the tubular beam member 12 so that the collars 63 may be rotatably supported on the beam member 12. To enhance the surface area with which the collar 63 engages the beam member 12, the axial extent of each collar 63 may be greater than the thickness of the wall 60 through which that collar 63 passes. As such, each collar 63 provides a bearing surface 65 which rotatably engages the tubular beam member 12.

If desired, the outer surface 56 of the concavo-convex wall 60 can be embossed with a decorative pattern and/or the corporate logo or trade name.

The inner surface 58 of each wall 60 may have a plurality of radially extending strengthening ribs 66, and an annular rib 68 may intersect the radial ribs 66 intermediately of the collar 63 and the peripheral wall 61. These ribs 66 and 68 enhance the structural integrity of the side walls 60. The inner surface 58 also presents four attachment extensions 69 which extend axially therefrom at circumferentially spaced intervals. Each extension 69 on cap 55A has a central opening 70 which is adapted to be engaged by a self tapping fastener, or screw, 71, as best depicted in FIGS. 3 and 4. The axially aligned, opposed extensions 69 on cap 55B each have a bore 72 extending therethrough which also penetrates the concavo-convex wall 60. The fasteners 71 are insertably received through the bores 72 and are threadably engageable with the central openings 70 to secure the caps 55A and 55B into a unitary whole.

Figure 1:
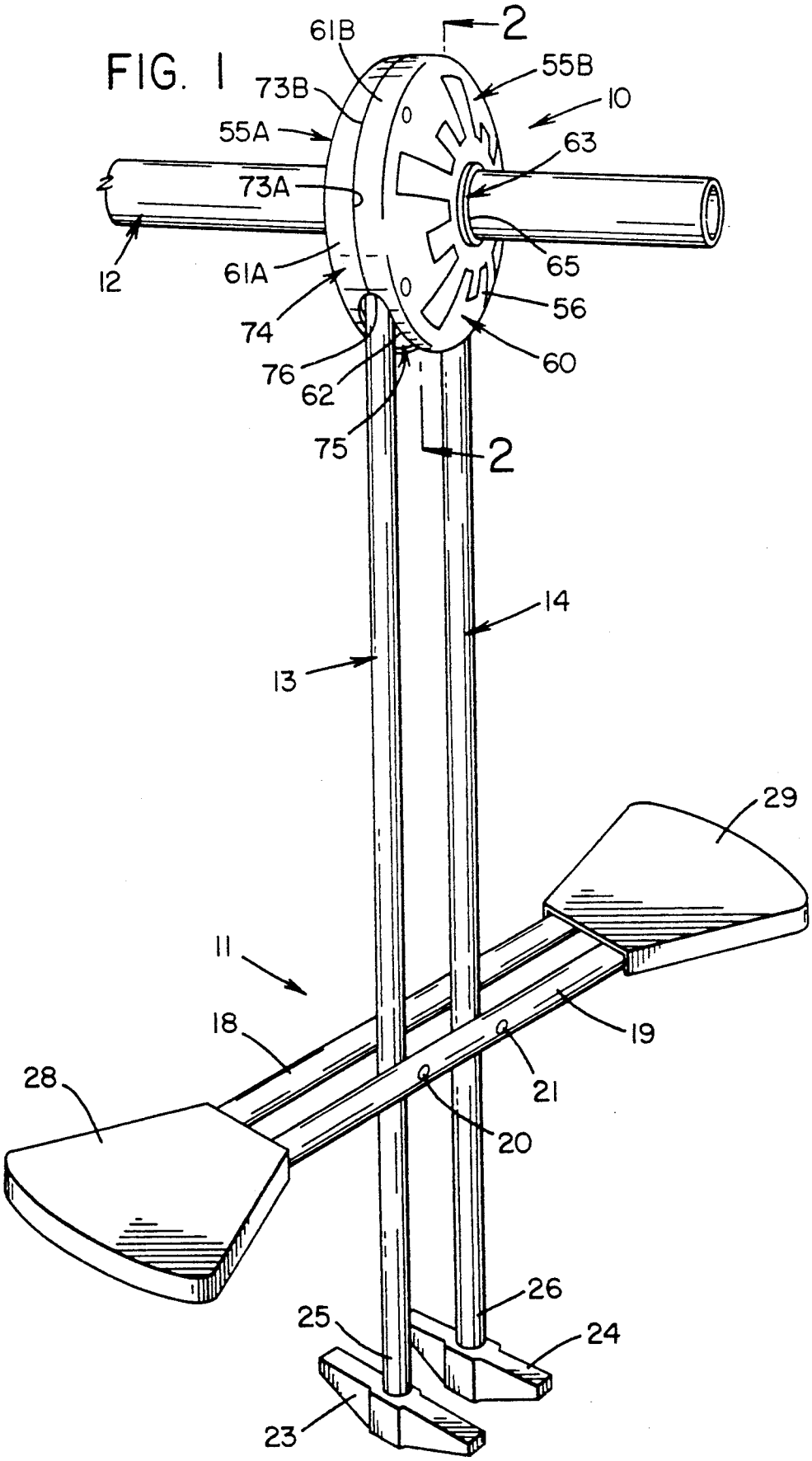
FIG. 1 is a perspective view of a portion of a play gym depicting a glide swing with an exemplary embodiment of a protective cover incorporating the concepts of the present invention positioned over the connection between the horizontal beam member and a pair of depending hanger bars.

When the axially oriented peripheral walls 61A and 61B are brought into abutment along their respective, axially opposed surface 73A and 73B the peripheral walls 61 form a substantially continuous, annular portion 74 of the cover assembly 10, as depicted in FIG. 1, and the recessed portions 62 define a slot 75, the circumferentially spaced, first and second ends 76 and 78 of which closely embrace the hanger bars 13 and 14. That is, the circumferential distance between the ends 76 and 78 is substantially equal to the span "d" of the hanger bars 13 and 14.

The slot 75 is disposed at a significant distance radially outwardly from the pivot connections 45. Because the slot 75 closely embraces the hanger bars 13 and 14, and because the slot 75 is spaced radially outwardly from one of the pivot pins 45, the likelihood of any unauthorized or accidental contact with the pivot connections is minimized. It should be appreciated that by mounting the cover assembly 10 rotatably on the beam member 12, the slot 75 need be of only the minimal circumferential dimension which allows the ends 76 and 78 to embrace the hanger bars 13 and 14 quite closely so the aforesaid result may be assured.

The vertical disposition of the hanger bars 13 and 14 constitutes the maximum value of the span "d". Thus, when the hanger bars 13 and 14 are swung in a counterclockwise direction—to the chain-line position depicted in FIG. 2—the hanger bar 14 will engage the end 78 of slot 75, causing the assembly 10 to rotate in a counterclockwise direction as viewed in FIG. 2. Because the hanger bars 13 and 14 remain parallel, the span of the hanger bars 13 and 14 will decrease slightly. As a result, the space between the hanger bar 13 and the end 76 of the slot 75 will increase slightly (the displaced location of end 76 is identified as **76*a* in FIG. 2), but not sufficiently to permit access to the pivot connection. As the hanger bars pivot in a clockwise direction, the assembly 10 will be rotated in a clockwise direction by the hanger bar 13, and the space between the hanger bar 14 and the end 78 of slot 75 will separate slightly, but no more than the separation previously described between bar 14 and the end 78 of slot 75**.

The foregoing description of an exemplary embodiment of the invention has been presented merely for the purpose of illustration. The description is not intended to be exhaustive nor is it intended to limit the scope of the invention to the precise form disclosed. Modifications, or variations, are possible in light of the foregoing teachings. The exemplary embodiment disclosed herein was chosen and described to provide a representative illustration of the principles of the invention as applied to one practical application. By that approach one of ordinary skill in the art is enabled to utilize the invention in various embodiments and in various modifications as are best suited to a particular installation. All such modifications and variations are within the scope of the invention as determined by the appended claims when interpreted in accordance with the breadth to which they are fairly, legally and equitably entitled.

As should now be apparent, the present invention not only teaches that a protective cover embodying the concepts of the present invention constitutes an unobtrusive attachment to a glide swing which presents a minimal vertical opening to accommodate swinging hanger bars and to prevent objects from being pinched between the opening and the swinging bars by allowing the cover to rotate with the swinging bars but also that the other objects of the invention can likewise be accomplished.

I claim:

1. A protective cover assembly for a play gym having a horizontal beam member, a hanger bracket supported from said beam member and a pair of hanger bars pivotally depending from the hanger bracket for swinging motion through an angular extent, said cover assembly comprising:

a pair of mirror-image caps each including a concavo-convex wall having an outer circumference and a central portion;

a collar means extending through the central portion of said concavo-convex wall to be rotatably received on the horizontal support beam;

a perpheral wall presented from the outer circumference of said concavo-convex wall;

said peripheral wall being recessed along a predetermined circumferential extent;

fastener means for securing the mirror-image caps together with the peripheral walls being disposed in abutment, said collar means being axially aligned and said recesses defining a slot of sufficient axial dimension as well as of sufficient, predetermined circumferential dimension to receive the hanger bars.

2. A protective cover assembly, as set forth in claim 1, wherein said fastener means further comprises:

a plurality of attachment extensions presented from the concavo-convex wall on each said cap, said extensions being disposed in axially aligned pairs;

one of each opposed pair of said attachment extensions having a central opening and the other of each said opposed pair having a bore that penetrates said concavo-convex wall;

a fastener being insertably received through each said bore to be secured within the central opening in said opposed attachment extension.

3. A glide swing and protective cover assembly comprising:

a horizontal beam member;

a hanger bracket;

a pair of hanger bars depending from said hanger bracket in parallel relation and being pivotally mounted thereon for swinging motion through an angular range from a vertical orientation, said vertical orientation defining the maximum span of said hanger bars;

a pair of mirror-image caps each having a concavo-convex wall including an outer circumference and a central portion;

collar means presented from said central portion to be rotatably supported on said horizontal beam member;

a peripheral wall extending along the outer circumference of said wall;

each said peripheral wall being recessed along a circumferential extent that is substantially equal to the maximum span of said hanger bars;

a plurality of fastener means for securing the mirror image caps together with the peripheral walls on said caps being disposed in abutment, said collar means being axially aligned and said recesses defining a slot within which said hanger bars may be received;

said slot having first and second ends;

the circumferential distance between the first and second ends of said slot being circumferentially spaced a distance sufficient to accommodate the hanger bars at their maximum span; and, said hanger bars contacting said ends to cause said cover assembly to rotate on said support beam as said hanger bars are swung.

* * * * *